United States Patent [19]

Byrne

[11] Patent Number: 4,996,823

[45] Date of Patent: Mar. 5, 1991

[54] METHOD OF PACKAGING A BEVERAGE AND A PACKAGE STRUCTURE

[75] Inventor: William J. Byrne, Mount Merrion, Ireland

[73] Assignee: Arthur Guinness Son & Company (Dublin) Limited, Dublin, Ireland

[21] Appl. No.: 345,208

[22] Filed: Apr. 28, 1989

[30] Foreign Application Priority Data

Sep. 12, 1988 [GB] United Kingdom ..... 8821266

[51] Int. Cl.[5] ..... B65B 31/00; B65B 3/02; B65B 29/06; B65D 85/72

[52] U.S. Cl. ..... 53/410; 53/432; 53/467; 53/471; 426/115; 426/131; 426/397; 206/219; 220/906; 413/4

[58] Field of Search ..... 53/410, 423, 432, 433, 53/467, 470, 471, 474, 97, 510, 511, 486; 426/112, 115, 118, 119, 131, 394, 395, 397; 215/1 C, 6, DIG. 8; 206/216, 219, 221; 220/1 BC

[56] References Cited

U.S. PATENT DOCUMENTS

| | | | |
|---|---|---|---|
| 55,341 | 6/1866 | Morse | 215/6 |
| 611,520 | 9/1898 | Smith | 206/211 |
| 3,282,708 | 11/1966 | Cushman | 426/112 X |
| 3,305,368 | 2/1967 | Bourelle | 206/219 X |
| 3,342,009 | 9/1967 | Anderson | 53/432 |
| 3,607,303 | 9/1971 | Bingham | 426/397 X |
| 3,733,771 | 5/1973 | Megowen | 53/471 |
| 4,060,956 | 12/1977 | Goble | 53/432 |
| 4,588,000 | 5/1986 | Malin et al. | 53/432 X |
| 4,627,986 | 12/1986 | Bardsley et al. | 426/115 X |
| 4,693,054 | 9/1987 | Spargo | 53/432 |
| 4,703,609 | 11/1987 | Yoshida et al. | 53/474 X |
| 4,832,968 | 5/1989 | Forage et al. | 426/115 X |

FOREIGN PATENT DOCUMENTS

| | | | |
|---|---|---|---|
| 1266351 | 3/1972 | United Kingdom | 426/112 |
| 2182762 | 5/1987 | United Kingdom | 220/1 BC |

*Primary Examiner*—Horace M. Culver

[57] ABSTRACT

Method of packaging a beverage and a package structure has a cylindrical tube 1 over an end 3 of which is located a partition 2 having restricted orifice and both are sealed, for example by crimping, to the rim of tube 1. Primary chamber 4 is formed within the tube and secondary chamber 8 is formed between the partition 2 and closure 7 which chambers communicate through orifice 6. Chamber 4 is charged with beverage 11 containing gas in solution and sealed with end wall 12 crimped to the rim 9 of the tube 1. Prior to sealing chamber 9 is dosed with liquid nitrogen or carbon dioxide so that headspace 13 is pressurized. The package adjusts to a state of equilibrium in which beverage flows into the secondary chamber 8 to form headspace 14 therein. Upon opening of the package with pull tag 15 a pressure differential between the headspaces 14 and 13 causes beverage and/or gas in chamber 8 to be ejected through orifice 6 into beverage 11 and thereby gas in solution in the beverage to be liberated and form, or assist in the formation of, a head of froth on the beverage.

10 Claims, 1 Drawing Sheet

METHOD OF PACKAGING A BEVERAGE AND A PACKAGE STRUCTURE

TECHNICAL FIELD & BACKGROUND ART

This invention relates to a method of packaging a beverage and a package structure for use in such method. More particularly the invention concerns beverages containing gas in solution and packaged in a sealable, non-resealable, container which, when opened for dispensing or consumption of the beverage, permits gas to be evolved or liberated from the beverage to form, or assist in the formation of, a head or froth on the beverage. The beverages to which the invention relates may be alcoholic or non-alcoholic and will be packaged in a two chambered container so that when the container is opened, gas and/or beverage from one chamber is ejected into beverage in the other chamber to cause gas in solution in the beverage to evolve and form a head of froth. Advantages which are to be derived from such two chambered beverage packages and methods of packaging the beverage in the containers are discussed in our British Patent Specification No. package of the type referred to is disclosed in our British Pat. Specification No. 1,266,351 (which is also referred to in the aforementioned G.B. 2,183,592A).

The method of packaging the beverage in a two chambered container as proposed in G.B. 1,266,351 was found to be unacceptable commercially in view of difficulties experienced in gas pressurizing one of the chambers in the container and efficiently sealing the container following such pressurization. On the contrary, however, the preferred method of packaging the beverage disclosed in G.B. 2,183,592A in which one of the two chambers is provided by a hollow pod which is inserted within the container has met with considerable commercial success. Nevertheless, this latter packaging method is inconvenient and relatively expensive in so far as a conventional beverage container/packaging line has to be modified considerably, especially to provide for the insertion of the pre-formed hollow pods into the container prior to the container being charged with its required volume of beverage. It is an object of the present invention to provide an efficient method of packaging a beverage in a two chambered container as broadly envisaged by the disclosure in G.B. 2,183,592A and which method alleviates the requirement for inserting a hollow pod into a preformed container as a means for forming one of the chambers.

STATEMENT OF INVENTION & ADVANTAGES

According to the present invention there is provided a method of packaging a beverage containing gas in solution which comprises forming a tube (which will usually be substantially cylindrical); locating over one open end of the tube a partition wall having a restricted orifice so that the partition wall forms an end of a primary chamber in the tube; locating a closure wall over said partition wall and sealing the closure and partition walls to a circular rim of the tube to define a secondary chamber between the closure and partition walls which secondary chamber is sealed other than for communicating with the primary chamber through the restricted orifice; charging the primary chamber through the second open end of the tube with beverage containing gas in solution and sealing the second open end of the tube with an end wall so that the primary chamber is provided with a headspace at a pressure greater than atmospheric.

Further according to the present invention there is provided a package structure for use in the method specified in the immediately preceding paragraph and which comprises a tube (which will usually be substantially cylindrical) one end of which is provided with a partition wall having a restricted orifice therein and which partition wall forms an end of a primary chamber in the predominant part length of the tube; a closure wall which extends over said partition wall on the side thereof remote from the primary chamber, said partition wall and closure wall being sealed to a circular rim of the tube and defining therebetween a secondary chamber which is sealed other than for communicating with the primary chamber through the restricted orifice, and wherein the second end of the tube remote from the partition and closure walls is open to permit the primary chamber to be charged with beverage therethrough and subsequently sealed.

The present invention provides a convenient and inexpensive means of constructing the secondary chamber in a package structure which may have a profile conforming to that of a conventional beverage can. This will permit the package structure to be used on a conventional canning line in which the primary chamber is charged with the appropriate volume of beverage and subsequently sealed under conditions in which the headspace of the primary chamber is at a pressure greater than atmospheric. The necessity of inserting hollow pods into the primary chamber as discussed in the preferred embodiment of G.B. 2,183,592A is thereby avoided and package structures for use in the method of the present invention can simply be preformed and supplied on mass for charging and sealing to provide a beverage package in accordance with the teaching in our G.B. 2,183,592A.

The cylindrical tube and the closure and partition walls will usually be formed of metal or plastics provided that the partition and closure walls can be sealed with respect to each other and to the rim of the tube. The sealing will normally be effected by a seaming technique, for example the partition and closure walls can be applied simultaneously to the tube and the closure wall may be crimped to the rim of the tube and the crimping of the closure wall can simultaneously serve to crimp the peripheral marginal edge of the partition wall to the rim of the tube between such rim and the closure wall. Having this latter crimping technique in mind, it is possible, for example, for the tube and partition wall to be of plastics material while the closure wall is of sheet metal suitable for crimping a seam/seal. Alternatively the partition wall can be sealed to the tube rim prior to the closure wall being sealed to that rim.

The partition wall may be of any convenient profile but will usually be recessed to provide a concave surface on the side thereof adjacent to the closure wall. This concave surface can serve to provide a secondary chamber of adequate volume when the closure wall is substantially flat. The restricted orifice which, typically, will have a diameter in the order of 0.010 to 0.015 inches (0.25 to 0.38 millimeters) can be formed simultaneously with the partition wall for example during moulding or pressing of that wall over an appropriately sized and located pin or by boring or drilling the partition wall prior to, or subsequent to, that wall being fitted to the tube.

The beverage and gas (or gases) which the beverage contains in solution and the gas or gases which serve to pressurize the primary headspace are preferably as discussed in our Specification, G.B. 2,183,592A. The beverage may therefore typically be fermented such as beer, stout, ale, lager and cider, be a so-called soft drink such as fruit juice, squash, cola, lemonade, milk and milk-based drinks or be a more alcoholic-type drink such as spirits, liqueurs, wine or wine based drinks. The gas is typically at least one of carbon dioxide gas and inert gas (which latter term includes nitrogen).

For some beverages, particularly fermented beverages, it is desirable that the primary and secondary chambers are purged of air prior to the primary chamber being charged with the beverage. This purging may be effected in conventional manner by use of gas exchange techniques with nitrogen or carbon dioxide. The charging of the primary chamber may take place in an environment of the selected gas, usually nitrogen or carbon dioxide, under pressure so that when the second open end of the tube is sealed under these conditions the headspace in the primary chamber contains the selected gas at a pressure greater than atmospheric. Alternatively, or in addition, the surface of the beverage in the secondary chamber can be dosed with liquid nitrogen or liquid carbon dioxide prior to the fitting of the end wall to seal the primary chamber so that as the liquid dose evaporates the headspace of the primary chamber is pressurized to the required extent.

The end wall which is applied to seal the second open end of the tube may be conventional, for example a metal sheet which is seamed by crimping or otherwise to the rim at the second end of the tube.

It will be realized from the disclosure in G.B. 2,183,592A that when a beverage package formed by the method of the present invention is in equilibrium, the secondary chamber contains beverage derived wholly from the primary chamber and has a secondary headspace. When the package is opened for dispensing or consumption of the beverage, for example by piercing the end wall or ripping out a part of that end wall with a pull tag in conventional manner, a pressure differential develops between the headspace in the primary chamber and that in the secondary chamber causing beverage and/or gas in the secondary chamber to be ejected through the restricted orifice into the primary chamber to cause gas in solution in the beverage to be liberated and form or assist in the formation of a head of froth on the beverage.

DRAWINGS

One embodiment of a method of packaging a beverage with a package structure in accordance with the present invention will now be described, by way of example only, with reference to the accompanying illustrative drawings of FIGS. 1 to 4 which diagrammatically and sequentially show the development of the beverage package.

DETAILED DESCRIPTION OF DRAWINGS

Figure 1:
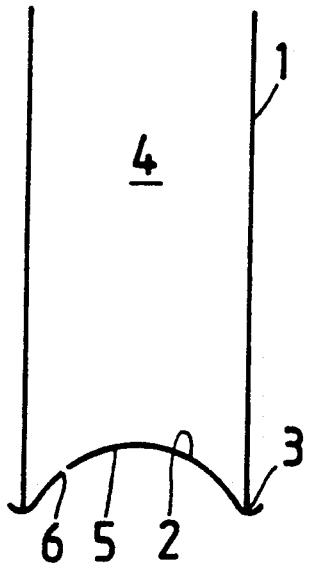

The beverage package is predominantly formed with a thin walled substantially cylindrical tube 1 typically of sheet metal. A circular dome shaped partition wall 2 is fitted over one of the open ends 3 of the tube 1 to form an end of a primary chamber 4 which extends over the predominant part length of the tube. The partition wall 2 is recessed to provide a concave surface 5 on the side of the partition wall remote from the primary chamber 4. The partition wall 2 is typically formed in thin sheet metal and has a restricted orifice 6 which communicates with the primary chamber 4 at a position adjacent to the wall of the tube 1.

A closure wall 7 in the form of a substantially flat circular disc of thin sheet metal is applied over the end of the tube 1 on the side of the partition wall 2 remote from the primary chamber. The circumferential marginal edges **7*a* of the two walls 2 and 7 overlie the circular rim of the tube end 3 and these walls are sealed to the rim of the tube 1 simultaneously by conventional crimping or seaming techniques. There is thus formed between the partition wall 2 and closure wall 7 a secondary chamber 8 which is sealed other than for communicating through the restricted orifice 6 with the primary chamber 4** as shown in FIG. 2.

Figure 2:
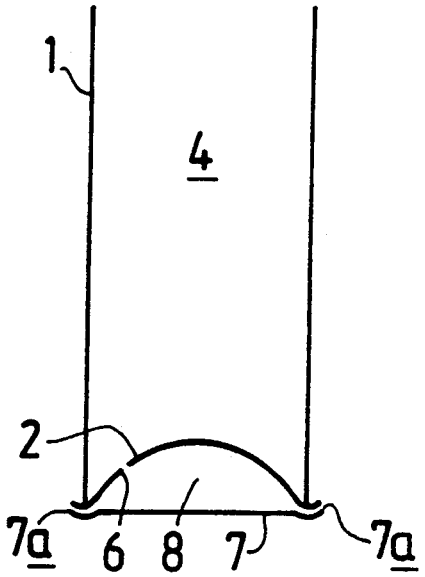
Figure 3:
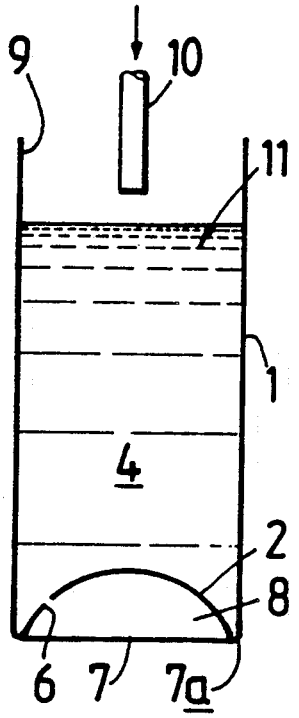
Figure 4:
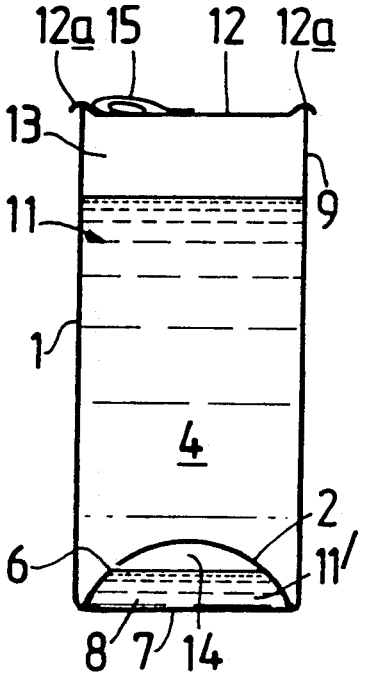

The package structure formed as shown in FIG. 2 can now be moved along a substantially conventional beverage canning line where the primary and secondary chambers are purged of air, for example by use of a conventional gas exchange technique whereby air in the structure is replaced with either carbon dioxide or nitrogen gas.

The structure is now charged with beverage (such as stout 11 containing gas in solution as disclosed in G.B. 2,183,592A through a filler nozzle 10 in the second open end 9 of the tube The surface of the beverage 11 in the primary chamber 4 is dosed with liquid nitrogen or liquid carbon dioxide (nitrogen being preferred) immediately prior to the open end 9 of the tube 1 being sealed with an end wall 12 in the form of a substantially flat circular disc of thin sheet metal. The circumferential marginal edge **12*a* of the end wall overlies the circular rim of the tube end 9 and is sealed to the rim by conventional crimping or seaming techniques. There is thus formed a primary headspace 13 to the beverage in the sealed primary chamber 4**.

The contents of the sealed package thus formed can now adjust to a position of equilibrium during which the dose of liquid nitrogen evaporates in the primary headspace and pressure within the package increases. Beverage 11 from the primary chamber 4 flows by way of the restricted orifice 6 into the secondary chamber 8 (as indicated at 11') to provide a secondary headspace 14 in the secondary chamber 8.

Both headspaces 13 and 14 are at a pressure greater than atmospheric and when the sealed package is opened, for example by ripping out a pull tag 15 in the end wall 12 in conventional manner, the pressure in headspace 13 rapidly reduces to atmospheric so that there is a considerable pressure differential between the secondary headspace 14 and the primary headspace 13. This causes beverage 11' in the secondary chamber to be ejected through the restricted orifice 6 into the beverage 11 in the primary chamber 4 and thereby gas in solution in the beverage to be evolved or assist in the formation of a head of froth on the beverage. It will be noted from the Figures that the restricted orifice 6 is located at a position whereby the secondary headspace 14 will be maintained with an adequate volume to achieve ejection of the beverage 11' for the intended purpose upon opening of the package and irrespective of the orientation or vibration to which the sealed package is likely to have been subjected, for example during transport. It will be appreciated however, that the profile of the partition wall 2 can be of a shape other than that illustrated, for example it may be of a corrugated form with concentric annular troughs and crests which are coaxial with the tube 1 and within which the restricted orifice is located in a trough adjacent to the closure wall 7 and substantially on the axis of the tube 1 so that the secondary headspace 14 will again be maintained once developed within the secondary chamber.

What is claimed is:

1. A method of packaging a beverage containing gas in solution which comprises forming a tube; locating over one open end of the tube a partition wall having a restricted orifice so that the partition wall forms an end of a primary chamber in the tube; locating a closure wall over said partition wall and sealing the closure and partition between the closure and partition walls which secondary chamber is sealed other than for being in constant communication with the primary chamber through the restricted orifice; charging the primary chamber through the second open end of the tube with beverage containing gas in solution so that the secondary chamber is charged with beverage derived from the primary chamber by way of the restricted orifice and sealing the second open end of the tube with an end wall having openable means so that each of the primary and secondary chambers is provided with a headspace at a pressure greater than atmospheric.

2. A method as claimed in claim 1 which comprises sealing the closure and partition walls substantially simultaneously to the rim of the tube.

3. A method as claimed in claim 1 which comprises applying the closure wall and partition wall simultaneously over said open end of the tube.

4. A method as claimed in claim 1 in which said closure wall is metallic and is sealed to the rim by crimping.

5. A method as claimed in claim 1 which comprises profiling the partition wall to provide a concave surface part on the side thereof adjacent to the closure wall.

6. A method as claimed in claim 1 which comprises sealing the second open end of the tube with an end wall seamed to the rim of the tube at that second open end.

7. A method as claimed in claim 1 which comprises purging the primary and secondary chambers of air with at least one of carbon dioxide and nitrogen gases prior to charging the primary chamber with the beverage.

8. A method as claimed in claim 1 which comprises providing the primary chamber with a headspace at a pressure greater than atmospheric by charging the primary chamber in an environment of at least one of nitrogen and carbon dioxide under pressure so that when the second open end of the tube is sealed the headspace in the primary chamber is at a pressure greater than atmospheric.

9. A method as claimed in claim 1 which comprises providing the primary chamber with a headspace at a pressure greater than atmospheric by dosing the beverage in the primary chamber with at least one of liquid nitrogen and liquid carbon dioxide prior to applying the end wall to seal the primary chamber so that the liquid dose evaporates and pressurizes the headspace of the primary chamber to a required extent.

10. A method as claimed in claim 1 which comprises forming the restricted orifice in the partition wall prior to locating the partition wall over said one end of the tube.

* * * * *